US005339486A

United States Patent [19]

Persic, Jr.

[11] Patent Number: 5,339,486

[45] Date of Patent: Aug. 23, 1994

[54] GOLF BALL CLEANER

[76] Inventor: William V. Persic, Jr., 1726 Crabtree La., Elkhart, Ind. 46514

[21] Appl. No.: 29,149

[22] Filed: Mar. 10, 1993

[51] Int. Cl.[5] ..... A47L 25/00

[52] U.S. Cl. ..... 15/244.1; 15/210.1

[58] Field of Search ..... 15/21.2, 104.94, 118, 15/160, 210.1, 244.1

[56] References Cited

U.S. PATENT DOCUMENTS

| | | | |
|---|---|---|---|
| 1,845,315 | 2/1932 | Meikle | 15/160 |
| 3,098,252 | 7/1963 | Sundquist | 15/210.1 |
| 3,378,873 | 4/1968 | Strout | 15/244.1 |
| 3,564,636 | 2/1971 | Tomer | 15/160 |
| 3,861,993 | 1/1975 | Guthrie | 15/118 |
| 4,084,287 | 4/1978 | Ingrram et al. | 15/210.1 |
| 4,187,574 | 2/1980 | Wrue | 15/210.1 |
| 5,003,659 | 4/1991 | Paepke | 15/244.1 |
| 5,004,239 | 4/1991 | Wettstein | 15/160 |

FOREIGN PATENT DOCUMENTS

| | | | |
|---|---|---|---|
| 6260 of 1894 | | United Kingdom | 15/21.2 |
| 213428 | 4/1924 | United Kingdom | 15/21.2 |
| 2120948 | 12/1983 | United Kingdom | 15/244.1 |

*Primary Examiner*—Timothy F. Simone
*Assistant Examiner*—Mark Spisich
*Attorney, Agent, or Firm*—James D. Hall

[57] ABSTRACT

A golf ball cleaner with a housing having the outward appearance of an ordinary golf ball, the housing separable into two hollow, semi-spherical sections for placement of a golf ball therein for cleaning. Each hollow section includes a pad made of a sponge-like material releasably attached to the interior face thereof. One pad further includes a layer of a slightly abrasive fiber on the outside surface thereof such that cleaning is effected without scratching the surface of the golf ball. The two halves are releasably joined at common, overlapping annular edges which allows rotation of one half relative to the other half about an axis perpendicular to the plane of joining. The twisting motion of the two halves and friction caused by the pads effect cleaning of the golf ball.

7 Claims, 4 Drawing Sheets

GOLF BALL CLEANER

BACKGROUND OF THE INVENTION

The present invention relates to devices for cleaning balls and, in particular, to devices for cleaning golf balls.

Heretofore, golf ball cleaners have been stationary objects located at various tee stations along the golf course. These prior art golf ball cleaners are generally not located at each tee station or between tees, and therefore a golfer having a soiled ball has to wait until he encounters a tee station having a golf ball cleaner.

Even when a golfer finds a golf ball cleaner at a tee station, they can be dry, or contain a dirty cleaning liquid. A dry golf ball cleaner will not clean a golf ball, while one with a dirty cleaning liquid defeats the purpose of cleaning the golf ball.

Furthermore, it is difficult to know whether the prior art golf ball cleaners are full or contain dirty water. Also it is generally not possible for the golfer to clean a dirty or contaminated golf ball cleaner or even add new water to it. Therefore, the golfer must take each golf ball cleaner as he finds it, as one cannot tell the condition of the golf ball cleaner until a golf ball has been removed therefrom.

Accordingly, it is desired to alleviate the problems and shortcomings of prior art golf ball cleaners.

Also, it is desired to provide a novel golf ball washer which is portable.

Furthermore, it is desired to provide a golf ball washer to which cleaning fluid can be easily added or where cleaning fluid can be easily changed.

SUMMARY OF THE INVENTION

The present invention provides a portable, compact golf ball cleaner which is adapted for easy use by a golfer.

In one form thereof, the present invention provides a golf ball cleaner comprising a housing member having first and second separable hollow parts releasably joined at mating annular edges. The annular edges constitute means for allowing rotation of the first and second hollow parts relative to each other when the first and second hollow parts are joined. First and second pads are respectively disposed within the first and second hollow parts. The first and second pad means are in opposed relationship to each other for accommodating a golf ball therebetween when the first and second hollow parts are joined. Each pad is caused to wipe the golf ball upon rotation of the first and second hollow parts relative to each other.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
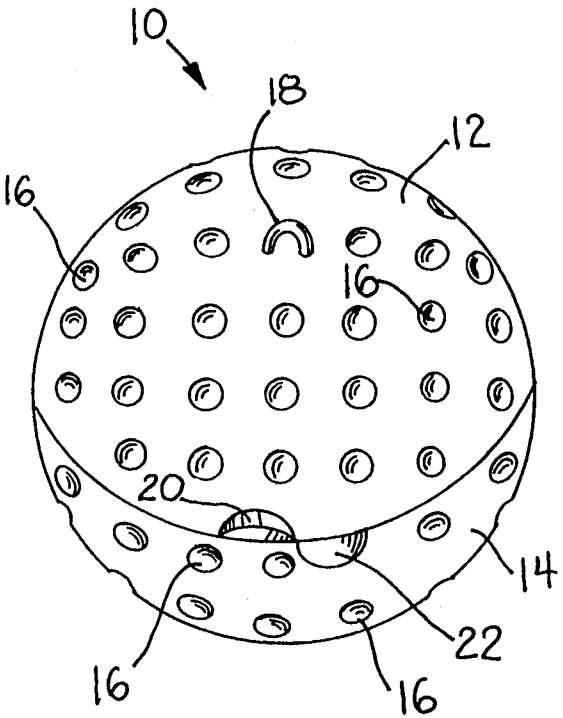
FIG. 1 is an elevational view of an embodiment of the present golf ball cleaner.

Referring in particular to FIG. 1, there is shown an embodiment of a golf ball cleaner 10 according to the present invention. Golf ball cleaner 10 includes an upper semi-spherical hollow half 12 and a lower semi-spherical hollow half 14, both halves constituting a housing. Each semi-spherical half 12, 14 has a plurality of dimples 16 in the outer surface thereof such that the outside of golf ball cleaner 10 resembles an ordinary golf ball.

Figure 4:
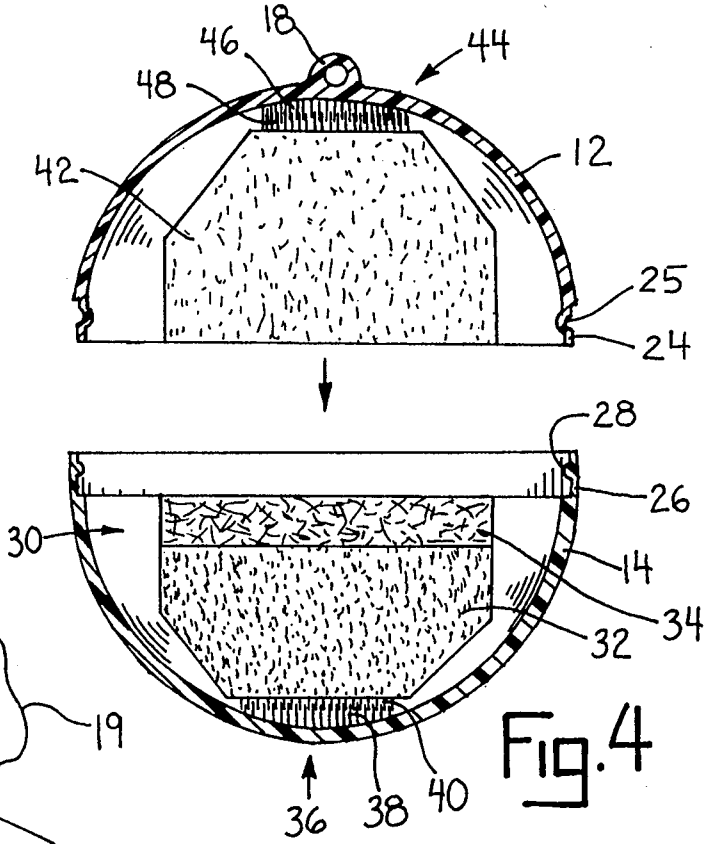
FIG. 4 is an exploded front sectional view of the golf ball cleaner of FIG. 1.

An integral hook 18 is centrally disposed on upper semi-spherical half 12. A line 19 (see FIG. 5) may be connected to hook 18 in order to retain golf ball cleaner 10. Formed in each half 12, 14 are respective thumb grooves or notches 20, 22 that permit the user to grasp and separate halves 12, 14 in order to place a golf ball therein for cleaning as described hereinbelow with reference to FIGS. 3 and 4.

Figure 2:
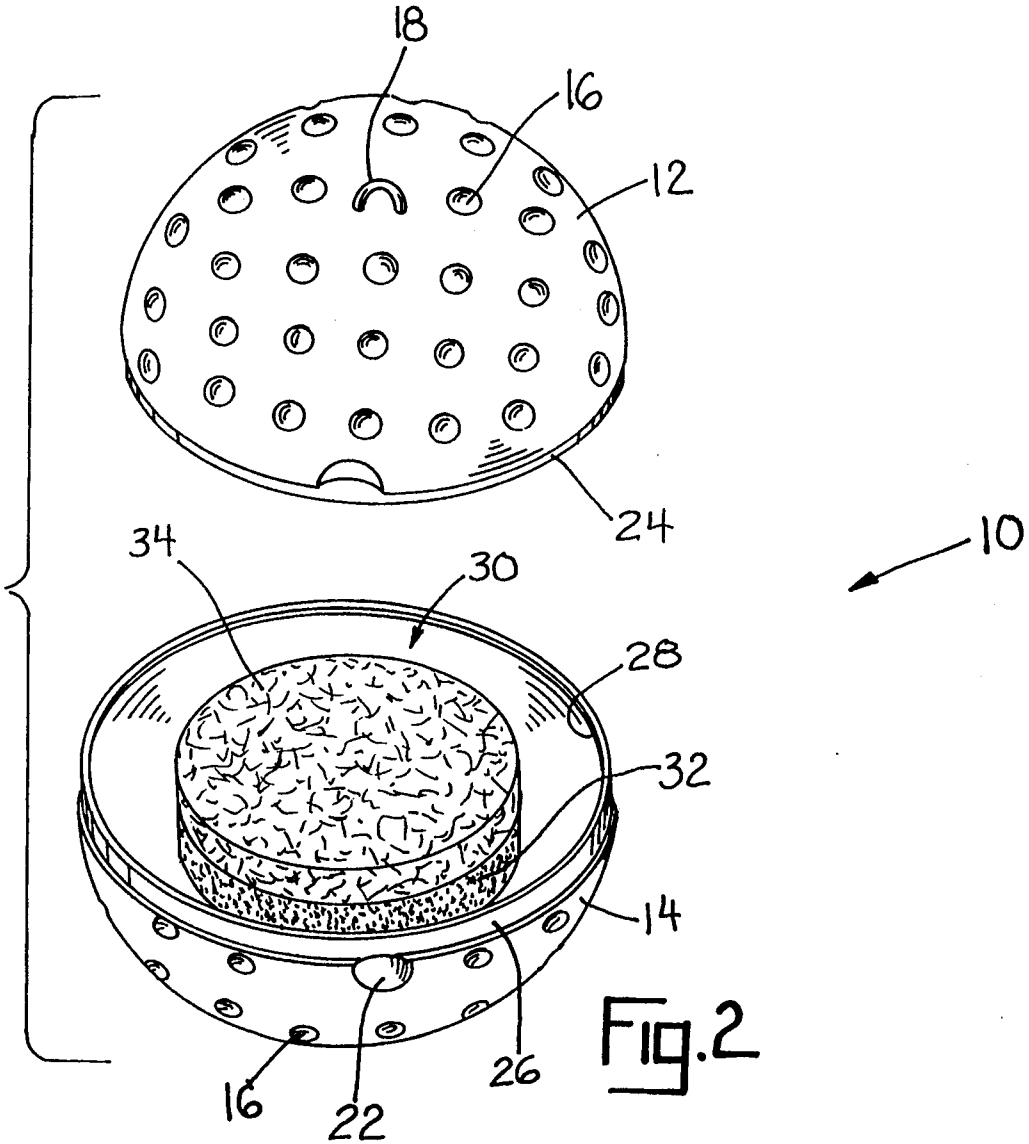
FIG. 2 is an exploded perspective view of the golf ball cleaner of FIG. 1.

As shown in FIG. 2, golf ball cleaner 10 is separable into the two halves 12 and 14. Upper half 12 includes an annular edge 24 which is slightly radially inset from the outer contour of upper half 12, while lower half 14 includes a complementary annular edge 26 which follows the outer contour of lower half 14. Disposed within lower half 14 is a pad 30 having a sponge-like portion 32 and a fibrous portion 34. Additionally referring to FIG. 4, pad 30 is releasably attached to the interior surface of lower half 14 by a Velcro ® strip 36 consisting of a loop portion 38 affixed to the interior surface of lower half 14 and a hook portion 40 affixed to a lower surface of sponge-like portion 32 of pad 30. Disposed within upper half 12 is a pad 42 of an entirely sponge-like material. In like manner to pad 30, pad 42 is releasably attached to the interior surface of upper half 12 by a Velcro ® strip 44 consisting of a loop portion 46 affixed to the interior surface of upper half 12 and a hook portion 48 affixed to an upper surface of pad 42. By releasably attaching pads 30 and 42 to respective halves 14 and 12, the pads may be easily removed for cleaning, remoistening or replacement when the need arises.

The pad bodies may be fabricated from any sponge type material that provides liquid or moisture retention and which is somewhat resilient for forming around or surrounding the golf ball during the washing process. Fibrous portion 34 of pad 30 is composed of a slightly abrasive fiber much like that used in kitchen scouring pads for removing food from pots and pans. Obviously, fibrous portion 34 should not be so abrasive as to scratch the surface of the golf ball.

It should be understood that although pad 30 with fibrous portion 34 is shown disposed in lower half 14 and pad 42 which does not have a fibrous portion is shown disposed in upper half 12, these pads may be interchangeable. Furthermore, pad 42 may be replaced with a pad similar to pad 30 having a fibrous portion on a face thereof. However, in this disclosed embodiment, only one pad includes a fibrous portion.

Annular edge 24 of upper half 12 includes an annular groove or channel 25 formed therein, while annular edge 26 of lower half 14 includes an annular ridge or rib 28 formed therein. Annular groove 25 and annular ridge 28 are complementary, in that annular ridge 28 snap fits into annular groove 25. The overlapping structure of annular edges 24, 26 with the mating structure of groove 25 and ridge 28 provides a snap fit for holding both halves 12, 14 together while concurrently permitting rotation of the halves relative to each other about an axis perpendicular to the plane of the joined edges.

Figure 3:
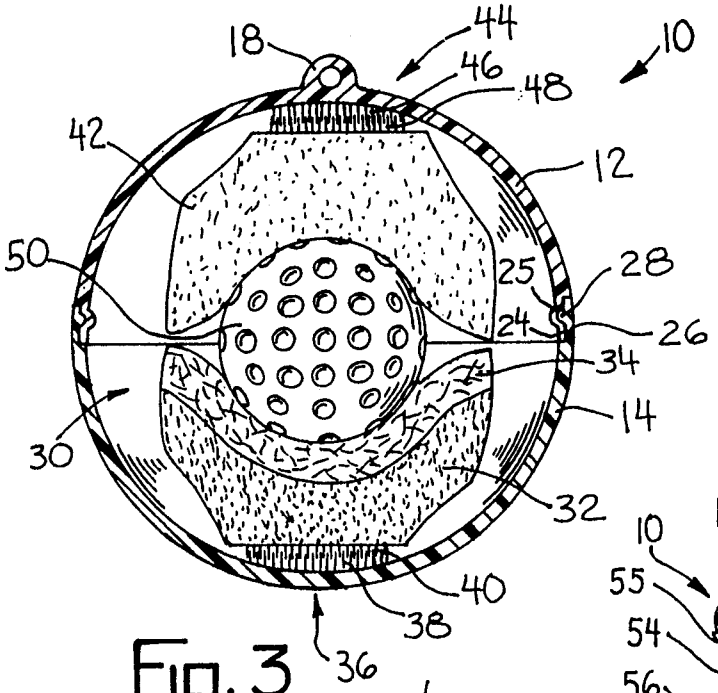
FIG. 3 is a front sectional view of the golf ball cleaner of FIG. 1 showing the cleaning of a golf ball.

FIG. 3 shows a golf ball 50 being washed in golf ball cleaner 10. Utilizing thumb grips 20, 22, halves 12, 14 are separated in order to place golf ball 50 therein. For purposes of the present description of the cleaning process, it is assumed that each pad 30, 42 has been moistened with water and/or a suitable cleaning agent prior to the placement therein of a golf ball. The pads retain the moisture for the cleaning process. Once halves 12, 14 are separated, golf ball 50 is then placed on lower pad 30. Halves 12, 14 are then rejoined by the snap fit of annular ridge 28 into annular groove 25. After gripping each half 12, 14, the halves are rotated or twisted relative to each other. This rotation or twisting motion of halves 12, 14 coupled with a slight amount of friction induced by fibrous portion 34 of lower pad 30, causes golf ball 50 to randomly rotate. The liquid and pad material effects the cleaning of golf ball 50. Once sufficient rotation of halves 12, 14 has occurred, halves 12, 14 are again separated and golf ball 50, now clean, is removed.

Once pads 30, 42 are dirty, they may be removed for cleaning or replacement. If pads 30, 42 need remoistening, they may either be removed for addition of water and/or a cleaning agent, or remoistened within their respective half.

Figure 5:
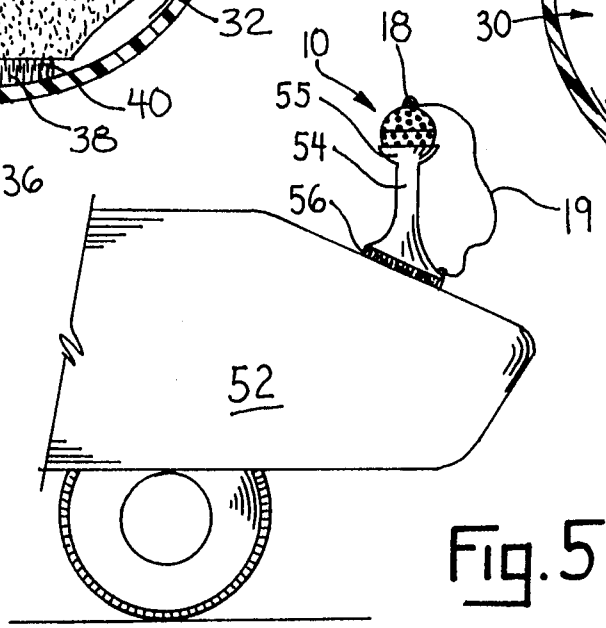
FIG. 5 is a partial elevational view of a golf cart showing the present golf ball cleaner mounted thereto.

Referring now to FIG. 5, it is contemplated that the present golf ball cleaner 10 will accompany the golfer rather than being a permanent, stand-alone device as is commonly utilized on golf courses. In one form thereof, golf ball cleaner 10 may be held in a stand 54 having a cup 55. A string or line 19 attached at one end to hook 18 is attached at the other end to stand 54. Stand 54 is preferably removably attached to the front end of a golf cart 52 by Velcro® or other suitable means. In this manner, golf ball cleaner 10 is available for use at any time.

Figure 6:
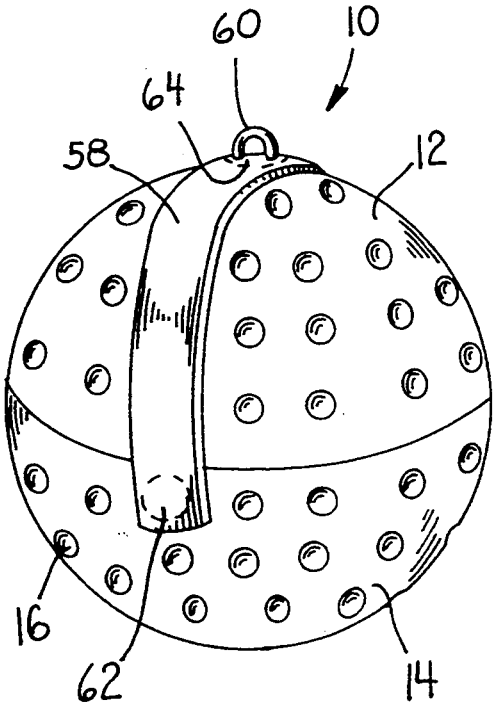
FIG. 6 is an elevational view of another embodiment of the present golf ball cleaner.
Figure 7:
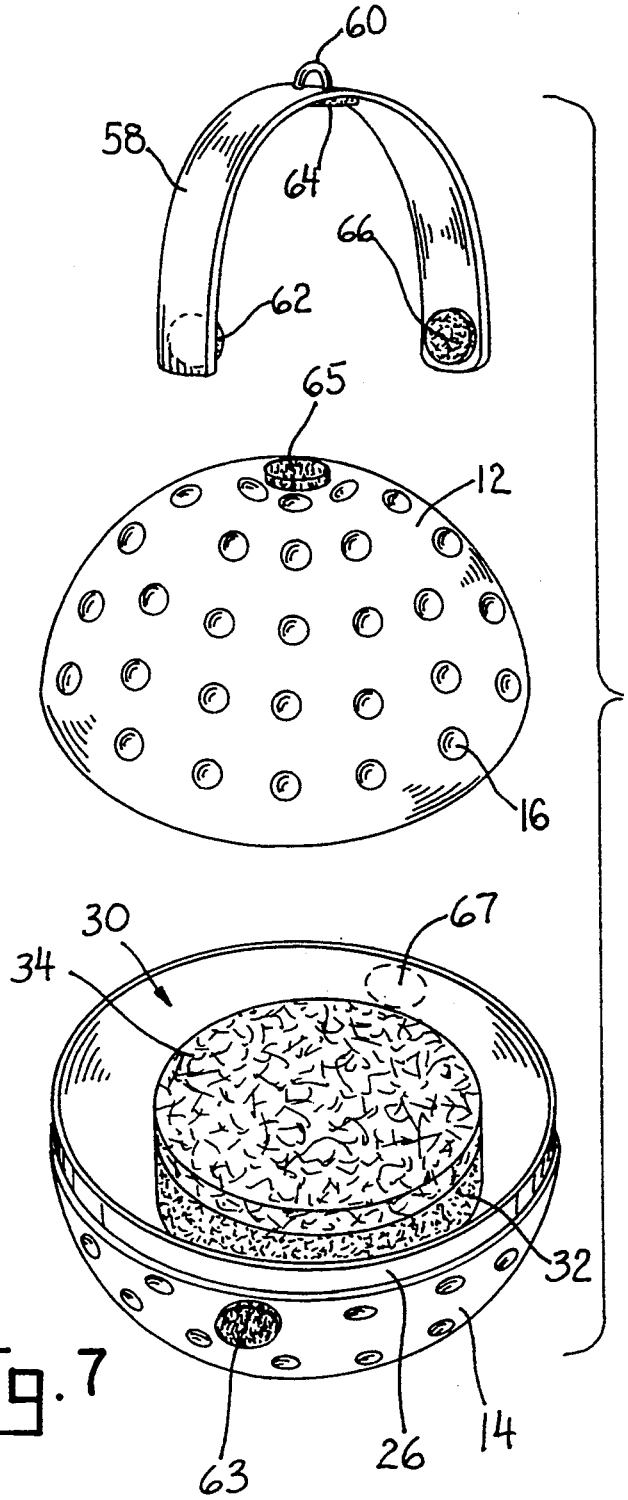
FIG. 7 is an exploded perspective view of the golf ball cleaner of FIG. 6.

Another embodiment of the present invention is depicted in FIGS. 6–9. Referring specifically to FIGS. 6 and 7 golf ball cleaner 10, in like manner to the embodiment depicted in FIGS. 1–4, includes an upper hollow semi-spherical half 12 and a lower hollow semi-spherical half 14. Dimples 16 are provided on the outer surface of halves 12, 14 simulating the outward appearance of an ordinary golf ball. A strap 58 having an integral hook 60 extends about upper half 12, with its ends attached to lower half 14 as described hereinbelow. Disposed on the underside of strap 58 are three hook portions 62, 64, 66 which respectively mate with three loop portions 63, 65, 67, the loop and hook portions being Velcro® or a similar material. Loop portions 63, 67 are disposed on lower half 14 diametrically opposed to each other, while loop portion 65 is disposed on upper half 12. Hook portions 62, 66 are thus situated on strap 58 so as to join with loop portions 63, 67, while hook portion 64 is thus situated under hook 60 so as to join with loop portion 65.

Figure 9:
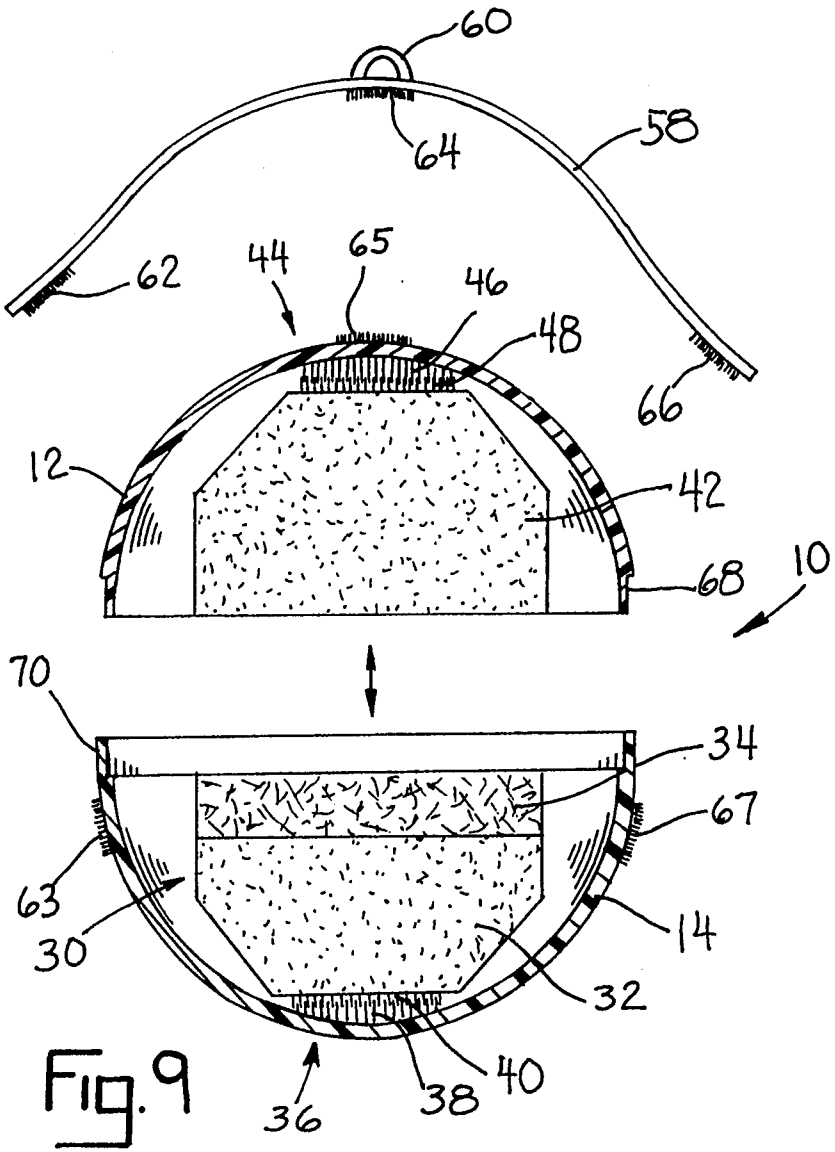
FIG. 9 is an exploded front sectional view of the golf ball cleaner of FIG. 6.
Figure 8:
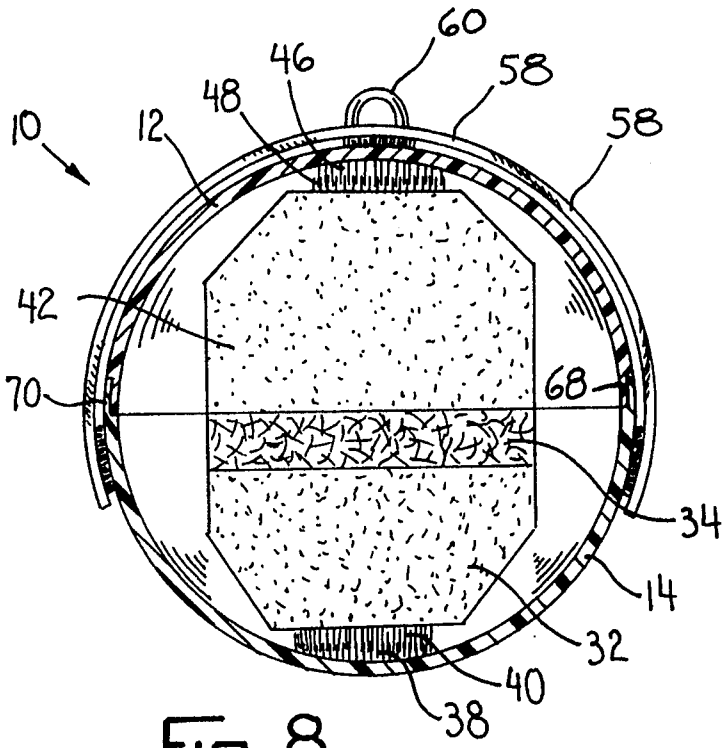
FIG. 8 is a front sectional view of the golf ball cleaner of FIG. 6.

Referring now to FIGS. 8 and 9, upper half 12 includes an inset annular edge 68 while lower half 14 includes an annular edge 70. Annular edges 68 and 70 are complementary as annular edge 68 overlaps or fits radially inwardly of annular edge 70. When halves 12, 14 are joined, such complementary edges 68, 70 allow rotation of each half relative to the other half about an axis perpendicular to the plane of joining. Strap 58 thus holds halves 12 and 14 together when not in use.

The embodiment of golf ball cleaner 10 as depicted in FIGS. 6–9 includes pads 30 and 42 attached to respective halves 14, 12 in the same manner as described hereinabove with reference to FIGS. 1–4. Pads 30 and 42 are the same as described with reference to and depicted in FIGS. 1–4. Furthermore, it should be understood that, with the exception of the manner of joining and attachment, golf ball cleaner 10 as depicted in FIGS. 6–9, and its method of cleaning a golf ball is entirely analogous to the golf ball cleaner depicted in FIGS. 1–4. Thus, the above description is applicable to the embodiment of FIGS. 6–9.

Also, Pad 32 can be removed from halve 14 by the golfer and used as a separate item for cleaning club heads.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A golf ball cleaner comprising:

a housing having first and second separable hollow parts each having an open face defined by an annular edge, said parts releasably joined together in a said face to said face configuration at said annular edges, said annular edges thereof permitting relative rotation of said first and second hollow parts relative to one another when said first and second hollow parts are joined together; and first and second pads respectively disposed within said first and second hollow parts, said first and second pads being in opposed facing relationship to each other for accommodating a golf ball therebetween when said first and second hollow parts are joined, whereby said pads are caused to wipe a said golf ball upon rotation of said first and second hollow parts relative to one another, means for separably joining said first and second hollow parts including a strap extending over an outer surface of one of said first and second hollow parts and releasably attached at opposite ends to an outer surface of the other of said first and second hollow parts.

2. The golf ball cleaner of claim 1, wherein one of said first and second pads includes an abrasive lining on an outer surface thereof which is in opposed facing relationship to the other of said first and second pads.

3. The golf ball cleaner of claim 1, further comprising:

means for removably attaching said first and second pads to said respective first and second hollow parts.

4. The golf ball cleaner of claim 3, wherein said means for removably attaching comprises hook and loop material.

5. A golf ball cleaner comprising:

a housing having first and second hollow semi-spherical halves each terminating in an annular edge, said halves separably joinable at said annular edges, one of said annular edges being radially inward of the other of said annular edges;

means for separably joining said first and second halves while permitting rotation of said first and second halves relative to one another about said annular edges when said first and second halves are joined together; and first and second pads detachably disposed in respective said first and second halves, said first and second pads in opposed facing relationship relative to each other and accommodating a golf ball therebetween for cleaning thereof, wherein each pad is caused to wipe a said golf ball therebetween upon rotation of said first and second halves relative to one another, said means for separably joining said first and second halves including a strap extending over an outer surface of one of said first and second halves and releasably attached at opposite ends to an outer surface of the other of said first and second halves.

6. The golf ball cleaner of claim 5, wherein one of said first and second pads includes a fibrous lining on an outer surface thereof in opposed facing relationship to the other of said first and second pads.

7. The golf ball cleaner of claim 5, wherein said first and second pads are detachably connected to said first and second halves respectively by hook and loop material.

* * * * *